US010633217B2

(12) United States Patent
Hong

(10) Patent No.: US 10,633,217 B2
(45) Date of Patent: Apr. 28, 2020

(54) REEL HOUSING FOR DUAL USE

(71) Applicant: Precision Dynamics Corporation, Valencia, CA (US)

(72) Inventor: Zhipeng Hong, Xiamen (CN)

(73) Assignee: Precision Dynamics Corporation, Valencia, CA (US)

( * ) Notice: Subject to any disclaimer, the term of this patent is extended or adjusted under 35 U.S.C. 154(b) by 0 days.

(21) Appl. No.: 16/222,552

(22) Filed: Dec. 17, 2018

(65) Prior Publication Data

US 2019/0185290 A1 Jun. 20, 2019

Related U.S. Application Data

(60) Provisional application No. 62/608,263, filed on Dec. 20, 2017.

(51) Int. Cl.

| | |
|---|---|
| ***A45F 5/00*** | (2006.01) |
| ***B65H 75/40*** | (2006.01) |
| ***B65H 75/48*** | (2006.01) |
| ***B65H 75/44*** | (2006.01) |

(52) U.S. Cl.

CPC ..... *B65H 75/406* (2013.01); *A45F 5/004* (2013.01); *B65H 75/4471* (2013.01); *B65H 75/48* (2013.01); *A45F 2005/006* (2013.01); *A45F 2200/055* (2013.01); *B65H 2701/1914* (2013.01)

(58) Field of Classification Search

CPC .... A45F 5/004; A45F 5/021; A45F 2005/006; B65H 75/4434; Y10S 224/93

See application file for complete search history.

(56) References Cited

U.S. PATENT DOCUMENTS 3,233,591 A * 2/1966 Rogers ..... A01K 27/004 119/796
3,968,670 A * 7/1976 Quenot ..... A45F 5/004 70/456 R
5,640,922 A * 6/1997 Feldkamp ..... B63C 11/26 114/315
5,833,165 A * 11/1998 Paugh ..... A44B 15/005 242/379.2
5,864,925 A * 2/1999 McGee ..... A45F 5/004 24/3.11
5,887,550 A * 3/1999 Levine ..... A01K 27/004 119/796
5,938,137 A * 8/1999 Poulson ..... A45F 5/004 242/379.2
6,085,393 A * 7/2000 Tsui ..... A44B 99/00 24/3.12
6,364,237 B1 * 4/2002 Kagel ..... A45F 5/004 242/371

(Continued)

*Primary Examiner* — Brian D Nash
(74) *Attorney, Agent, or Firm* — Quarles & Brady LLP

(57) ABSTRACT

A badge reel device is attachable to a user via a lanyard or an attachment clip. The badge reel device includes a housing, a retractable cord partially disposed within the internal volume of the housing and extending through the aperture of the housing for attachment to a badge, an attachment clip on the housing (with the attachment clip being configured for attachment to the user to wear the badge reel device in a first wearing mode), and a lanyard attachment structure on the housing (with the lanyard attachment structure being configured for attachment to a lanyard, for the user to wear the badge reel device in a second wearing mode).

18 Claims, 8 Drawing Sheets

(56) References Cited

U.S. PATENT DOCUMENTS 6,633,770 B1 * 10/2003 Gitzinger ..... A45F 5/00 224/191
7,007,882 B2 * 3/2006 Raia ..... A45F 5/004 242/379
7,774,969 B1 * 8/2010 Silverman ..... H05K 5/0278 224/257
8,505,114 B1 * 8/2013 Earley ..... A45F 5/004 2/101
8,600,461 B2 * 12/2013 Kroupa ..... H04M 1/15 455/575.1
8,757,532 B2 * 6/2014 Votel ..... B65H 75/4434 242/378
9,204,710 B1 * 12/2015 Burns ..... A45F 5/00
2002/0135999 A1 * 9/2002 Chen ..... A45F 5/004 362/116
2002/0148078 A1 * 10/2002 Salentine ..... A45F 5/004 24/115 F
2003/0042348 A1 * 3/2003 Salentine ..... A45F 5/004 242/380
2004/0089759 A1 * 5/2004 Genuise ..... A45F 5/004 242/379
2006/0163412 A1 * 7/2006 Szarkowski ..... B65H 75/4434 242/384
2007/0051842 A1 * 3/2007 Pryor ..... A45C 11/182 242/378.3
2008/0042000 A1 * 2/2008 Horton ..... A01K 27/004 242/382
2008/0083829 A1 * 4/2008 Lowe ..... A45C 11/18 235/486
2008/0106409 A1 * 5/2008 Schmidt ..... A44B 15/005 340/568.1
2008/0283651 A1 * 11/2008 Ito ..... A45F 5/004 242/386
2010/0206976 A1 * 8/2010 Salentine ..... A45F 5/004 242/379.2
2010/0314479 A1 * 12/2010 Kish ..... A01K 27/004 242/376
2011/0174852 A1 * 7/2011 Young ..... A45F 5/021 224/268
2011/0233078 A1 * 9/2011 Monaco ..... A45C 11/00 206/223
2012/0055965 A1 * 3/2012 Zhang ..... B65H 75/4434 224/269
2013/0168423 A1 * 7/2013 Paugh ..... A45F 5/004 224/162
2013/0284772 A1 * 10/2013 Paugh ..... A45F 5/004 224/162
2014/0175135 A1 * 6/2014 Paugh ..... A45F 5/004 224/219
2015/0157116 A1 * 6/2015 Williams ..... A45F 5/004 224/162
2017/0215293 A1 * 7/2017 Merenda ..... H04B 1/3888
2018/0279747 A1 * 10/2018 Harlee ..... A45F 5/004

* cited by examiner

REEL HOUSING FOR DUAL USE

CROSS-REFERENCE TO RELATED APPLICATION

This application claims the benefit of the filing date of U.S. Provisional Patent Application No. 62/608,263 entitled "Reel Housing for Dual Use" filed on Dec. 20, 2017, which is hereby incorporated by reference for all purposes as if set forth in its entirety herein.

FIELD OF INVENTION

This disclosure relates to badge or identification card attachments such as, for example, badge reels to which a badge or an identification card is retractably attached via a cord.

BACKGROUND

Identification cards or badges are utilized in various industries. In some case, these cards or badges may be issued to an individual and contain information corresponding to the individual. These cards or badges then allow authorized access to particular regions within a building (for example, a factory, an office, a hospital, and so forth). In some instances, the card or badge contains electronically stored information (for example, an RFID ("Radio-frequency identification") tag), which allows the individual in possession of the card or badge to access particular regions of a building by bringing the card or badge in close proximity to a sensor (for example, an RFID reader).

Thus, a card or badge given to an individual is typically desired to be worn at all times, to ensure that the individual can access the granted regions within a building and to ensure that the individual has the badge or card on their person for use at any time. To facilitate user retention of a card or badges, devices exist that secure the card or badge to the user. Such devices often include a cord-and-reel type connection between the card or badge and the housing which is in some way attached to the user so that the user may temporarily extend the card or badge to a desired reader location (for example, a RFID card reader or optical scanner).

SUMMARY

Most conventional badge or card reels are designed for a single mode of attachment to the wearer so that the wearer does not lose the badge or card. For example, many card reels are designed to only be attached to the belt or waistband of the wearer via a clip with the card being attached via a retractable cord. Still other card reels are designed to be attached to a lanyard which is then received around the neck of the wearer.

However, such conventional badge reel constructions can be particularly limiting to the wearer, especially when other factors, such as usage environment, comfort, or fashion are taken into consideration. For example, a belt clip attachment may be very utilitarian for most use cases, but a user may not always be wearing pants with a belt or waistband. Likewise, a lanyard configuration may be viewed as more formal, but not acceptable in certain factory environments that include industrial machinery (for example, mills, lathes, and so forth) and where loose fitting garments are prohibited. Still further, if a lanyard is used without a retractable reel (as is often the case because the lanyard already has some length), then the user may periodically need to crane his or her body to place the card or badge where needed.

Disclosed herein is an improved badge reel device that is attachable to the user in multiple ways. It includes both an attachment clip for attachment to a belt or waistband, for example, as well as a lanyard attachment structure to accommodate wearing the device around the neck of the user. Among other things, this provides the benefit of a single structure that can be worn in a diverse number of ways and a card or badge does not need to be switched between two or more different single-mode attachment structures depending on the particular day or usage condition.

A system is disclosed that includes a badge reel device that is attachable to a user via a lanyard or an attachment clip. The badge reel device includes a housing having sidewalls that have an exterior surface and an interior surface. The interior surface defines an internal volume of the housing. The housing includes an aperture for a cord extending through the sidewalls, and a retractable cord partially disposed within the internal volume of the housing and extending through the aperture of the housing for attachment to a badge at a badge-attachment end of the retractable cord. The badge reel device further includes an attachment clip on the housing, where the attachment clip is configured for attachment to the user to wear the badge reel device in a first wearing mode via the attachment clip. The badge reel device also includes a lanyard attachment structure on the housing, where the lanyard attachment structure is configured for attachment to a lanyard, for the user to wear the badge reel device in a second wearing mode via the lanyard.

In some forms of the system, the badge reel device can further include a front cover and a rear cover connected together. The front cover and the rear cover may have a clamshell configuration, in which the front cover and the rear cover are securedly engaged with one another.

In some forms of the system, an exterior portion of the front cover can include a label, with the label being an advertisement, a logo, or a brand name as some examples.

In some forms of the system, the badge-attachment end of the retractable cord can include a badge clip that can receive the badge. The badge clip can include an aperture for receiving an end of the retractable cord, thereby securing the badge clip to the end of the retractable cord. The housing can further include a recess configured to receive the badge clip when the retractable cord is in a retracted state. The receiving of the badge clip into the recess of the housing can prevent rotation of the badge clip, thereby also preventing rotation of the badge clip relative to the housing. Likewise, the badge clip can be dimensioned such that when the badge clip receives the badge, rotation between the badge and the badge clip is prevented.

In some forms of the system, the lanyard attachment structure can be a loop.

In some forms of the system, the lanyard attachment structure can include a lanyard clip (which may be received on the loop). The lanyard clip can include a lanyard slot configured to receive the lanyard.

In some forms of the system, the badge reel device can include a spool disposed within the internal volume of the housing and biased in a first direction in which at least a portion of the retractable cord partially disposed within the internal volume is wrapped around the spool. When tension is provided to the portion of the retractable cord extending through the aperture of the housing, the spool can rotate in a second direction, thereby unraveling a greater length of the retractable cord. Upon releasing the tension on the portion of the retractable cord extending through the aperture of the housing, the spool can rotate back in the first direction thereby retracting the greater length of the retractable cord onto the spool.

In some forms of the system, the attachment clip can be configured to slidably engage a portion of clothing. The portion of clothing can be a belt, a belt loop, or a waist region of a pair of pants.

These and still other advantages of the invention will be apparent from the detailed description and drawings. What follows is merely a description of some preferred embodiments of the present invention. To assess the full scope of the invention the claims should be looked to as these preferred embodiments are not intended to be the only embodiments within the scope of the claims.

DETAILED DESCRIPTION

Figure 1A:
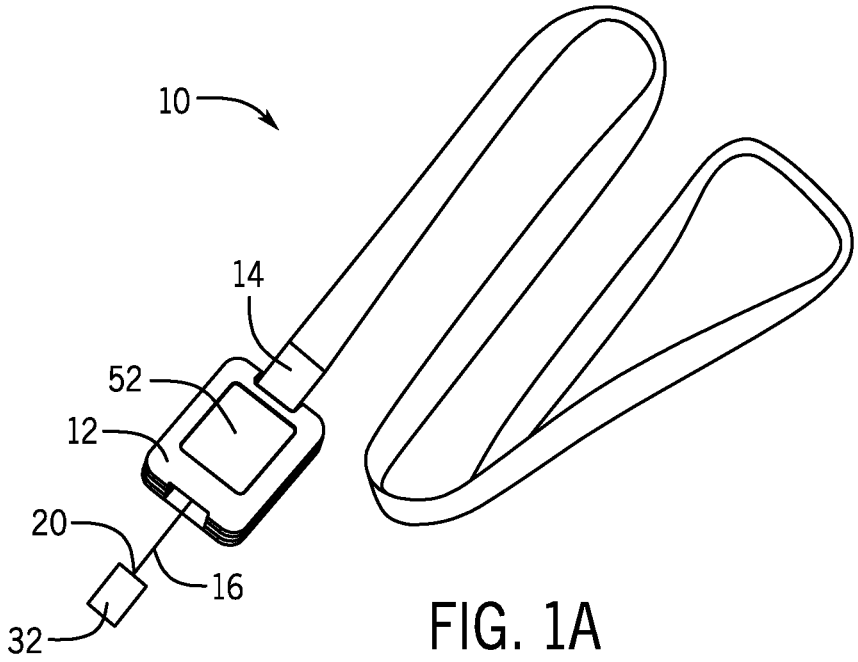
FIG. 1A is a perspective front view of a badge reel device.

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless specified or limited otherwise, the terms "mounted," "connected," "supported," and "coupled" and variations thereof are used broadly and encompass both direct and indirect mountings, connections, supports, and couplings. Further, "connected" and "coupled" are not restricted to physical or mechanical connections or couplings.

As used herein, unless otherwise limited or defined, discussion of particular directions is provided by example only, with regard to particular embodiments or relevant illustrations. For example, discussion of "top," "front," or "back" features is generally intended as a description only of the orientation of such features relative to a reference frame of a particular example or illustration. Correspondingly, for example, a "top" feature may sometimes be disposed below a "bottom" feature (and so on), in some arrangements or embodiments.

The following discussion is presented to enable a person skilled in the art to make and use embodiments of the invention. Various modifications to the illustrated embodiments will be readily apparent to those skilled in the art, and the generic principles herein can be applied to other embodiments and applications without departing from embodiments of the invention. Thus, embodiments of the invention are not intended to be limited to embodiments shown, but are to be accorded the widest scope consistent with the principles and features disclosed herein. The following detailed description is to be read with reference to the figures, in which like elements in different figures have like reference numerals. The figures, which are not necessarily to scale, depict selected embodiments and are not intended to limit the scope of embodiments of the invention. Skilled artisans will recognize the examples provided herein have many useful alternatives and fall within the scope of embodiments of the invention.

As used herein, unless otherwise specified or limited, "at least one of A, B, and C," and similar phrases, are meant to indicate A, or B, or C, or any combination of A, B, and/or C. As such, this phrase, and similar other phrases can include single or multiple instances of A, B, and/or C, and, in the case that any of A, B, and/or C indicates a category of elements, single or multiple instances of any of the elements of the categories A, B, and/or C.

As used herein, the term identification badge describes physical structure(s) that contain identification corresponding to the user associated with the badge. For example, an identification badge can include an RFID tag, a one-dimensional barcode, a two dimensional barcode. It is understood that other terms such as identification cards can be used interchangeably with the term identification badge. Moreover, when describing identification badges, other tangible objects that contain personalized information can be used in reference to an identification badge. Examples of these can include, but are not limited to, logos, brand names, images, advertisements, a user's name, titles, and so forth.

Figure 1B:
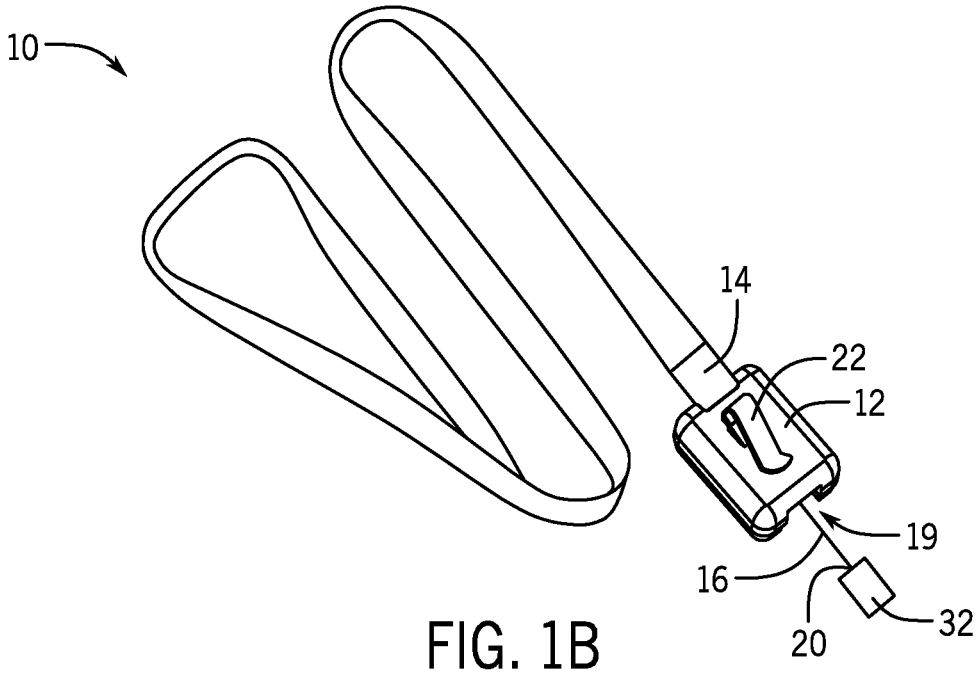
FIG. 1B is a perspective back view of the badge reel device of FIG. 1A.

As illustrated in FIGS. 1A and 1B, the badge reel device 10 includes a housing 12 having an exterior and an interior surface. The housing 12 also includes a lanyard attachment structure 14 (schematically represented, although a detailed example follows in FIGS. 5A through 5D) located on an end of the housing 12 and configured to removably affix a lanyard to the housing 12. The housing 12 is further configured to include a retractable cord 16 (also schematically represented, although a detailed example follows in FIGS. 4A through 4D) located on an end of the housing 12, opposite the lanyard attachment structure 14. Most of the retractable cord 16 is located within the housing 12; however, a portion of the retractable cord 16, as illustrated in FIGS. 1A and 1B, extends through an aperture 18 of the housing 12 and is located exteriorly relative to the housing 12. This portion of the retractable cord 16 includes a badge-attachment end 20 that can attach to a user's identification badge. In some embodiments, the retractable cord 16 can be made of various materials (e.g., nylon).

As best illustrated in FIG. 1B, the rear side of the housing includes an attachment clip 22. As shown, the attachment clip 22 is formed of metal, however, other materials can be used (for example, plastics, wood, and so forth). The attachment clip 22 is configured to secure the housing 12 relative to the user. For example, the attachment clip 22 can slide over a belt or waistband of a user, thereby securing the housing 12 to the user. In some embodiments, the attachment clip 22 can slide over a shirt pocket of a user. Although the attachment clip 22 is illustrated as a sliding clip, other attachment mechanisms can be used to secure the housing 12 to the user. For example, the attachment clip 22 can be a spring clip, a derlin clip, a push clip, a bulldog swivel clip, a clip connector, a lever clip, a mobile connector, an alligator clip, and so forth.

Figure 1C:
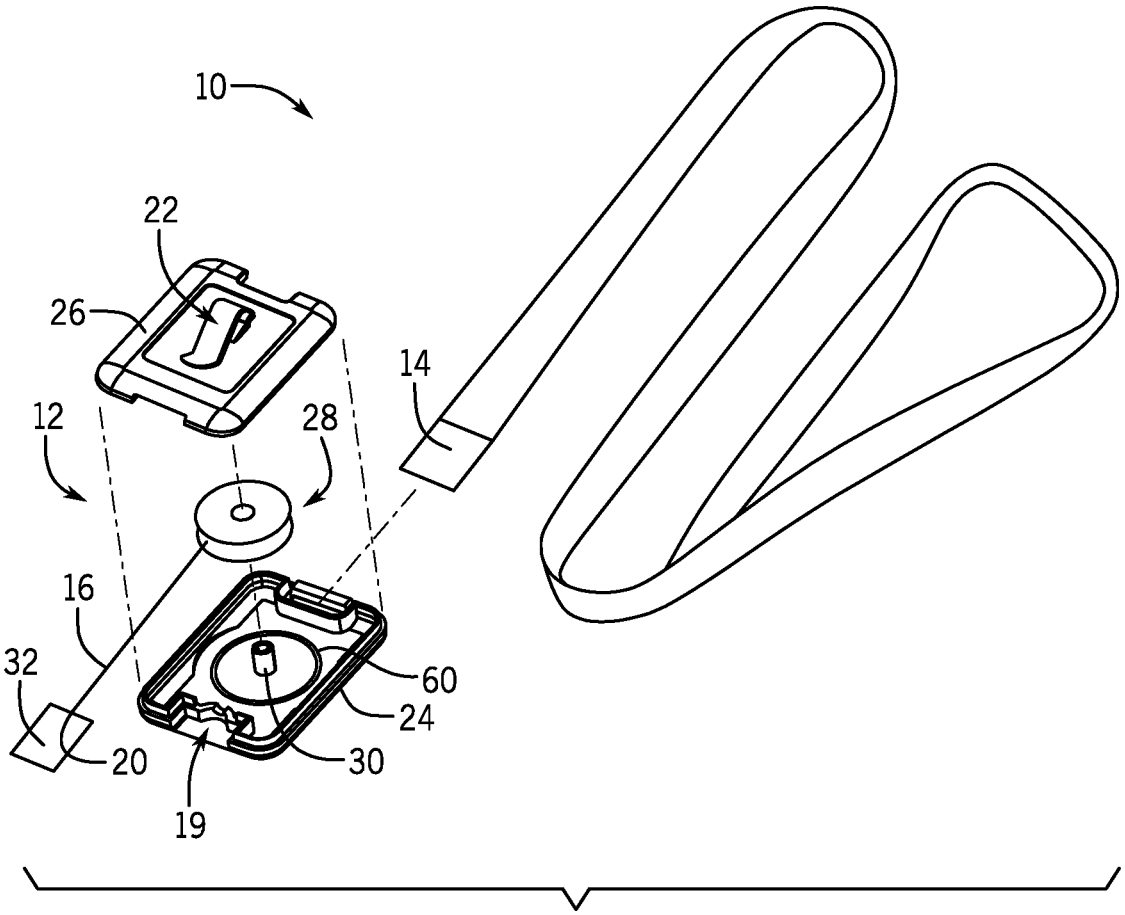
FIG. 1C is an exploded view of the badge reel device of FIG. 1A in which some elements are represented schematically.

FIG. 1C illustrates an exploded view of the badge reel device 10. The housing 12 of the badge reel device 10 is formed by the connection between a front cover 24 and a rear cover 26. The front cover 24 and the rear cover 26 can be made of various materials. For example, the front cover 24 and the rear cover 26 can be made of plastic (e.g., polycarbonate). As discussed, the connection between the front cover 24 and the rear cover 26 defines an internal volume, where a spool 28 is located. The spool 28 includes two identical and generally parallel disks that are spaced apart and connected by a cylinder having a smaller radius than the two disks. The retractable cord 16 is wound around the cylinder of the spool 28. The spool 28 also includes a bore extending through the entirety of the cylinder, of which is received by an extruded cylinder 30 of the front cover 24.

Once the spool 28 is seated on the extruded cylinder 30, the front cover 24 is attached to the rear cover 26. Upon attachment between the front cover 24 and the rear cover 26, the spool 28 can rotate within the internal volume and translation along the extruded cylinder 30 is prevented. In some embodiments, the spool 28 can include a torsional spring, or other biasing members made of various materials (e.g., 301 stainless steel having a Vickers hardness number range of 570-585). The torsional spring or other biasing members allow the spool 28 to be rotationally biased when secured between the front cover 24 and the rear cover 26. For example, when the portion of retractable cord 16 that is exteriorly positioned with respect to the housing 12 is pulled in tension, the spool 28 is unwound in a first rotational direction, extending the length of the exteriorly positioned retractable cord 16, and thereby biasing the spool 28. When the tension is removed from the portion of retractable cord 16 that is exteriorly positioned, the spool 28 is rewound in a second rotational direction, opposite the first rotational direction, via the spring or other biasing members.

Figure 1D:
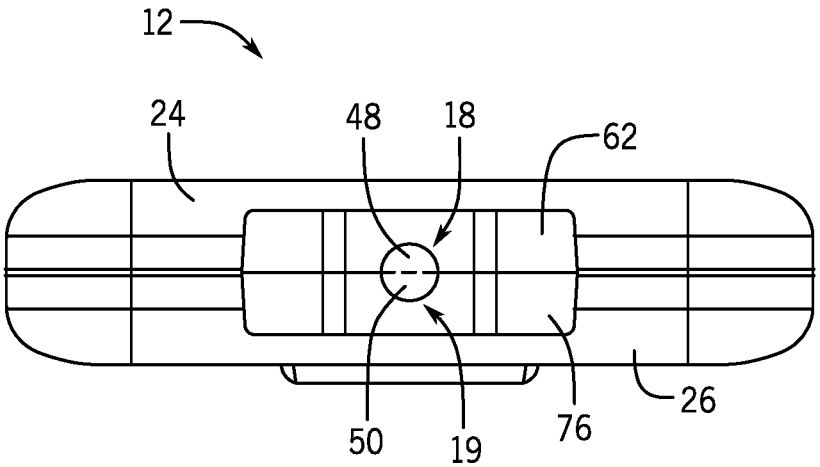
FIG. 1D is a bottom side view of a housing of the badge reel device of FIG. 1A without the badge attachment clip.

FIG. 1D illustrates a bottom side view of the housing 12. As discussed above, the housing 12 includes the aperture 18, which is generally circular and is formed by the joining of the front cover 24 and the rear cover 26. The front and rear covers 24, 26 each have a semicircular aperture 48, 50, respectively. The semicircular apertures 48, 50 together form the aperture 18, when the front cover 24 and the rear cover 26 are attached.

Referring to FIGS. 2A-2D, the front cover 24 includes a label region 52 on an exterior surface of the front cover 24. The label region 52 allows for placement of various identifiers, visible to others including the user. Examples of these identifiers include graphics, text, a logo, a flat label, a dome label, and so forth. The front cover 24 also includes an extruded edge 55 along the entire periphery of the front cover 24. The extruded edge 55 can allow for a snap fit connection with the rear cover 24 (although other forms connection are certainly contemplated).

Figure 2A:
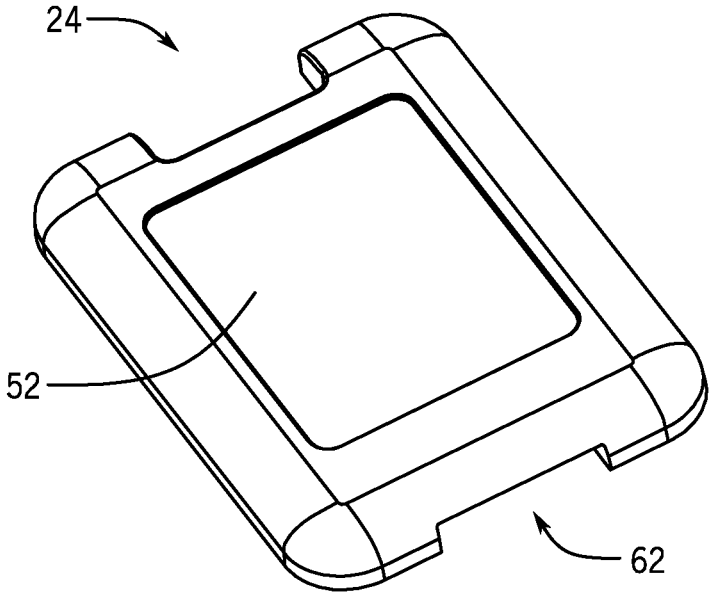
FIG. 2A is a perspective view of a front cover of the badge reel device of FIG. 1A showing the outside surface.
Figure 2B:
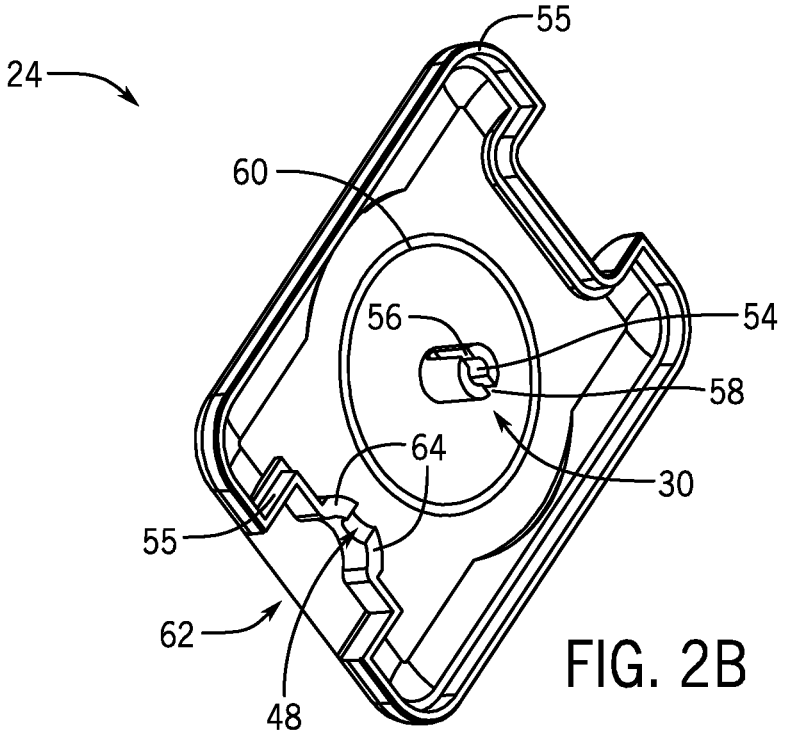
FIG. 2B is another perspective view of the front cover of the badge reel device of FIG. 1A showing the inside surface.
Figure 2C:
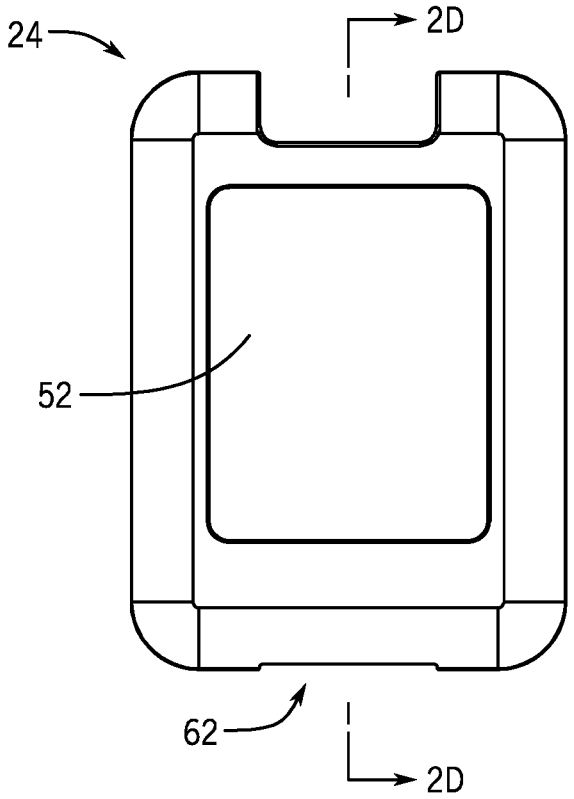
FIG. 2C is a front view of the front cover of FIG. 2A.
Figure 2D:
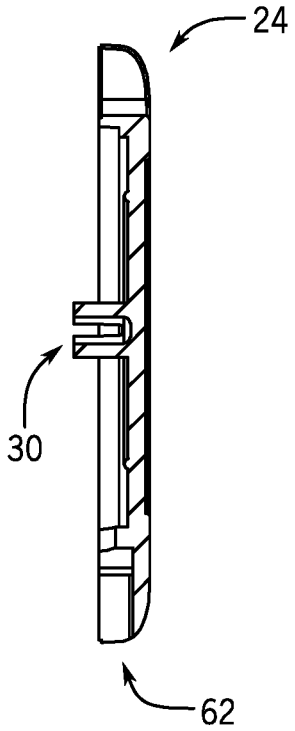
FIG. 2D is a cross-sectional view of the front cover of FIG. 2C, taken along line "2D-2D."
Figure 3A:
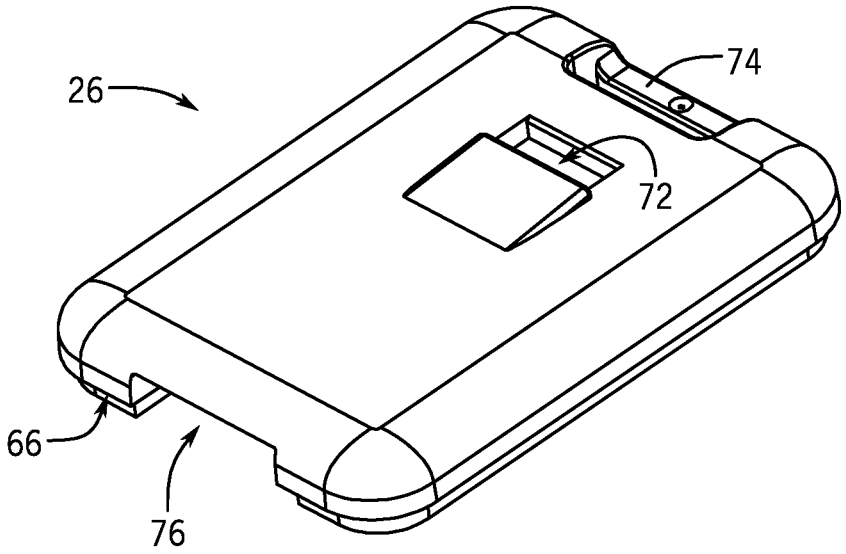
FIG. 3A is a perspective view of a rear cover of the badge reel device of FIG. 1A showing the outside surface.
Figure 3B:
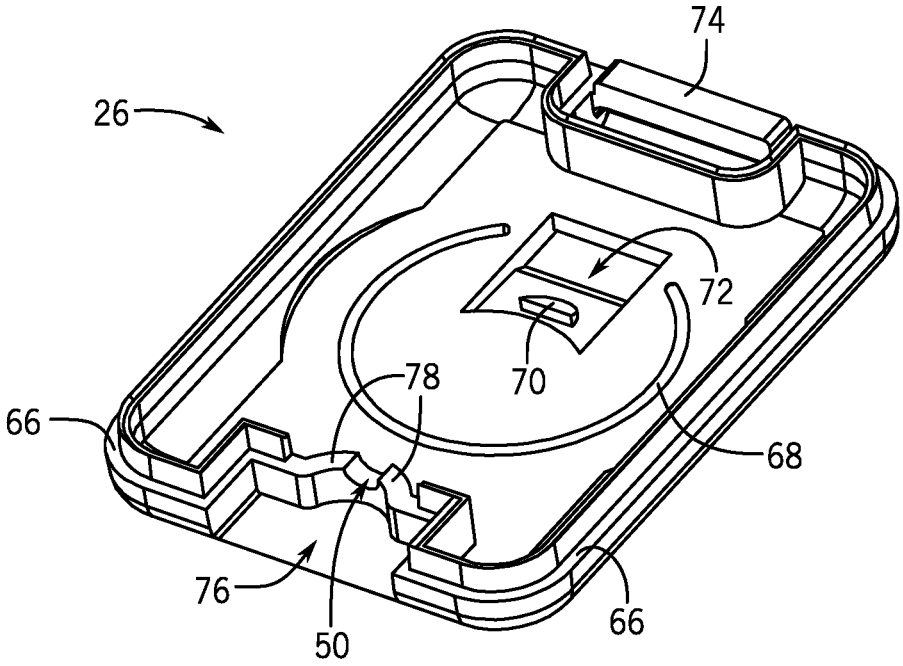
FIG. 3B is another perspective view of the rear cover of the badge reel device of FIG. 1A showing the inside surface.
Figure 3C:
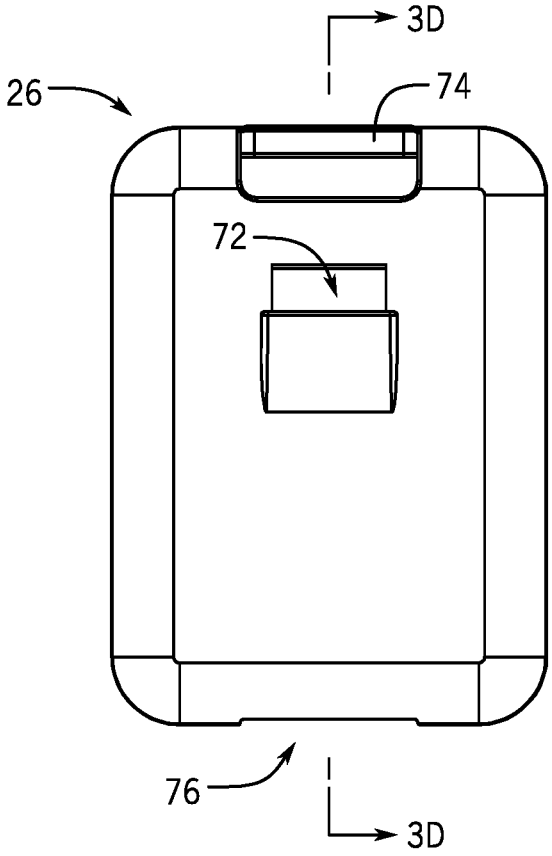
FIG. 3C is a front view of the rear cover of FIG. 3A.
Figure 3D:
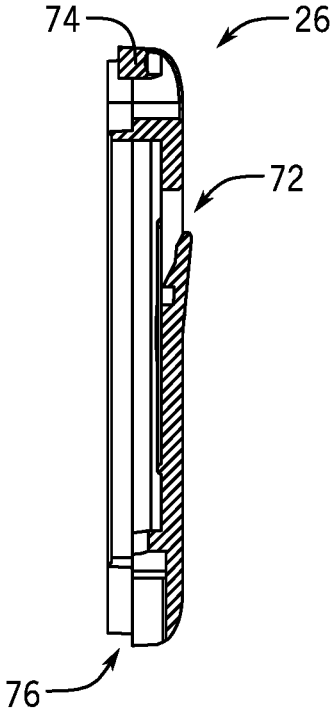
FIG. 3D is a cross-sectional view of the rear cover of FIG. 3C, taken along line "3D-3D."
Figure 4A:
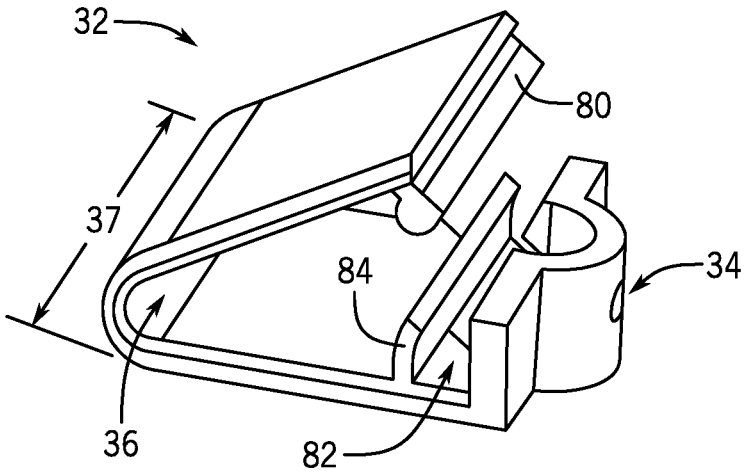
FIG. 4A is a perspective view of a badge clip of the badge reel device of FIG. 1A.
Figure 4B:
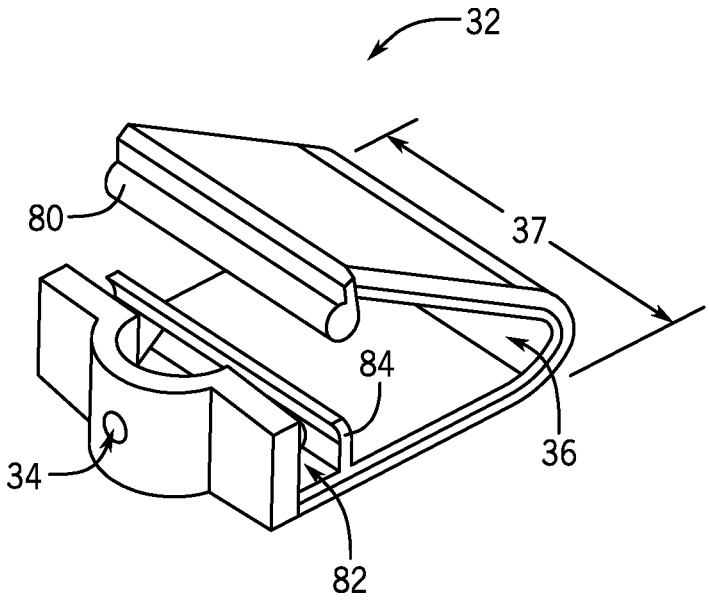
FIG. 4B is another perspective view of the badge clip of the badge reel device of FIG. 1A.
Figure 4C:
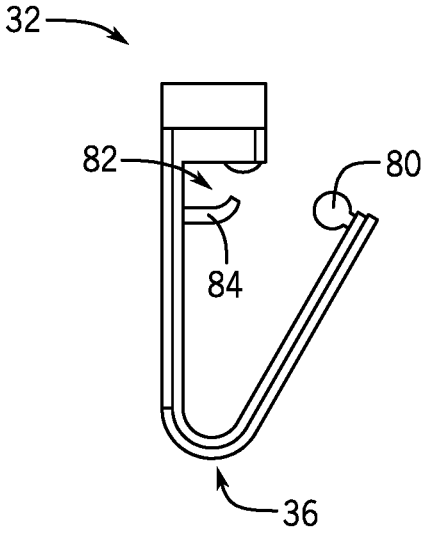
FIG. 4C is a side view of the badge clip of FIG. 4A.
Figure 4D:
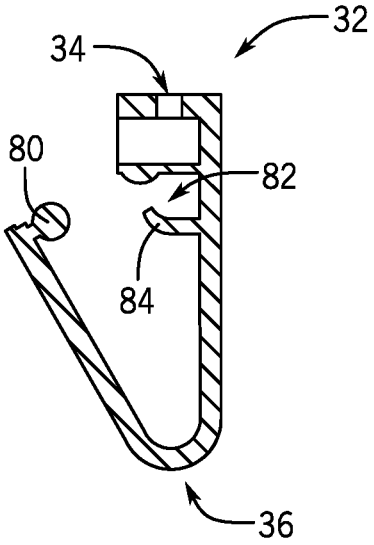
FIG. 4D is a side cross-sectional view of the badge clip of FIG. 4A.

The front cover 24 further includes an interior surface, opposite that of the exterior surface and this interior surface is best shown in FIG. 2B. Centrally located on the interior surface of the front cover 24, protrudes an extruded cylinder 30. The extruded cylinder 30 has an axial bore 54 extending through the entirety of the extruded cylinder 30. The extruded cylinder 30 also includes extruded cuts 56, 58 that begin on an axial surface between the axial bore 54 and the perimeter of the extruded cylinder 30 and extend through the entirety of the extruded cylinder 30. The axial bore 54 and extruded cuts 56, 58 receive the spool 28. Also located on the interior surface of the front cover 24 is a circular depression 60 that is concentrically located around the extruded cylinder 30, and that is configured to receive a portion of one of the parallel disks of the spool 28. This feature further secures and prevents translation of the spool 28 along the extruded cylinder 30. In some embodiments, the portion of the one of the parallel disks of the spool 28 can be an extruded edge located on the periphery of the parallel disk, such that this extruded edge is received within the circular depression 60.

This front cover 24 includes a front cover cavity 62 that defines part of the recess 19 of the housing 12. The front cover cavity 62 includes an extension 64, of which includes the semicircular aperture 48. As illustrated, the front cover cavity 62 is generally rectangular and effectively corresponds to the shape of the badge clip 32, such that a portion of the badge clip 32 can be received within the front cover cavity 62.

As shown in FIGS. 3A-3D, the rear cover 26 includes an extruded cut edge 66 along the entire periphery of the rear cover 26. This extruded cut edge 66 engages with the extruded edge 55, thus snapping and securing the front cover 24 and the rear cover 26 together. The rear cover 26 also includes an interior surface, opposite that of an exterior surface. The interior surface of the rear cover 26 includes a circular channel 68 configured to engage a portion of one of the parallel disks of the spool 28. Specifically, the one of the parallel disks of the spool 28 is the parallel disk opposite to that of the parallel disk received within the circular depression 60. Additionally, the portion of the one of the parallel disks of the spool 28 can be an extruded edge located on the periphery of the parallel disk, such that this extruded edge is received within the circular channel 68.

The interior surface of the rear cover 26 also includes a protrusion 70 configured to attach or affix the housing 12 to a base of the attachment clip 22. Similarly, the interior surface of the rear cover 26 also includes an opening 72 extending through the entirety of the rear cover 26, which is configured to receive a clip portion of the attachment clip 22. For example, the clip portion can include the metal engagement that slidably engages a belt or waistband of a user. The rear cover 26 also includes a lanyard beam 74 configured to engage the lanyard clip retaining portion 42 of the lanyard clip 40. In some embodiments, the lanyard can be affixed directly to or looped around the lanyard beam 74.

The rear cover 26 also includes a rear cover cavity 76 that defines the second portion of the recess 19. The rear cover cavity 76 also includes an extension 78, of with includes the semicircular aperture 50. As illustrated, the rear cover cavity 76 is generally rectangular and effectively corresponds to the shape of the badge clip 32, such that a second portion of the badge clip 32 can be received within the rear cover cavity 76. Although the rear cover cavity 76 is rectangular, other shapes and configurations are possible. For example, if the badge clip 32 is semicircular, the front cover cavity 62 and the rear cover cavity 76 can be semicircular, thus forming a semicircular recess 19. As such, generally, the recess 19, defined by the front cover cavity 62 and the rear cover cavity 76, effectively corresponds to the shape of the badge clip 32, thus securing the badge clip 32 within the recess 19.

As illustrated in FIGS. 4A-4D, the badge reel device 10 includes a badge clip 32. The badge-attachment end 20 of the retractable cord 16 is secured through a badge clip aperture 34 of the badge clip 32 (for example, by a knot). The badge clip 32 also includes a badge retaining portion 36, configured to receive a slot or hole of a badge identification card. As illustrated, the badge retaining portion 36 is located on an end of the badge clip 32, opposite to that of the badge clip aperture 34. As illustrated, the badge retaining portion 36 effectively is to sections having a living hinge therebetween in which the sections can be closed or separated to permit a badge to be inserted or removed when separated or to permit retention of the badge when closed. The badge clip 32 is ultimately receivable within a recess 19 of the housing 12 when the cord 16 is retracted. Generally, the badge clip 32 can be made of various materials that allow for the above-discussed functionality. For example, the badge clip 32 can be made of plastic (for example, polyoxymethylene, and so forth).

The badge clip 32 includes a cylindrical protrusion 80, emanating from an interior edge at the end of the badge clip 32. The badge clip 32 also includes a badge clip slot 82 that is substantially parallel relative to the cylindrical protrusion 80, and that includes a hooked edge 84 that curves away from the badge retaining portion 36. The badge clip slot 82 is configured to receive the cylindrical protrusion 80, where the hooked edge 84 retains the cylindrical protrusion 80, thus forming a loop and locking the badge clip 32. After locking the badge clip 32, the identification card that was received onto the badge retaining portion 36 of the badge clip 32 is prevented from sliding out of the badge clip 32. As illustrated, the badge clip 32 is structured as a "snap-clip," where the cylindrical protrusion 80 is forced into the badge clip slot 82, and the hooked edge 84 imposes a retracting force onto the cylindrical protrusion 80, thereby securing the cylindrical protrusion 80 into the badge clip slot 82. However, other clips known in the art (for example, a spring clip, a derlin clip, a push clip, a bulldog swivel clip, a clip connector, a lever clip, a mobile connector, an alligator clip, and so forth) can be substituted for the illustrated embodiment of the badge clip 32, in order to secure the identification card to the other clip and to attach the retractable cord 16 to the other clip.

As illustrated in FIGS. 5A-5D, the lanyard attachment structure 14 is configured as a lanyard clip 40. The lanyard clip 40 includes a lanyard slot 38 and a lanyard bar 46. The lanyard is received through the lanyard slot 38 and is coupled to the lanyard bar 46, for example, via a strap. The lanyard is thus connected to the lanyard clip 40. In some embodiments, the lanyard bar 46 includes a cutaway extending through the entirety of the lanyard bar 46, allowing a loop of a lanyard to be received through the cutaway and be disposed around the lanyard bar 46, thus allowing the lanyard to support the lanyard bar 46.

Referring back to FIGS. 5A-5D, the lanyard clip 40 also includes a lanyard clip retaining portion 42, allowing the lanyard clip 40 to support objects received in the lanyard clip 40. For example, based on the configuration, the lanyard clip 40 can receive and support either the identification card, or the lanyard beam 74 of the housing 12. Although the lanyard attachment structure 14 is configured as a clip, in some embodiments, other forms of clips can be substituted. For example, other additional clips, of which were discussed above (e.g., a spring clip, a derlin clip, a push clip, a bulldog swivel clip, a clip connector, a lever clip, a mobile connector, an alligator clip, and so forth) can be utilized to secure the lanyard to the lanyard clip 40, to secure the lanyard clip 40 to the identification card, or to secure the lanyard clip 40 to the lanyard beam 74 of the housing 12.

Figure 5A:
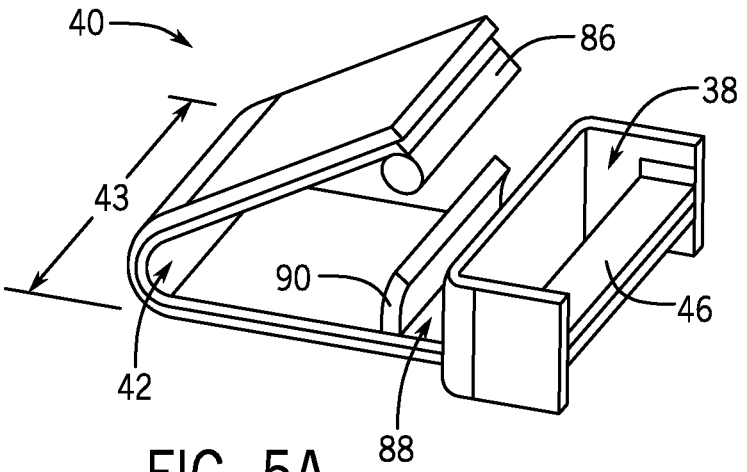
FIG. 5A is a perspective view of a lanyard clip of the badge reel device of FIG. 1A.
Figure 5B:
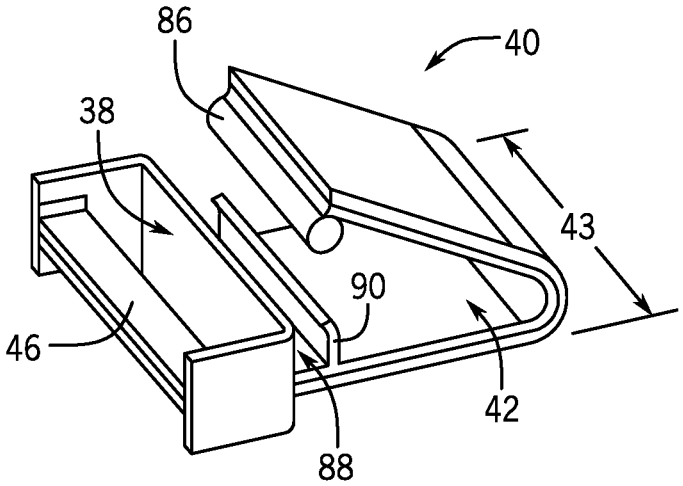
FIG. 5B is another perspective view the lanyard clip of the badge reel device of FIG. 1A.
Figure 5C:
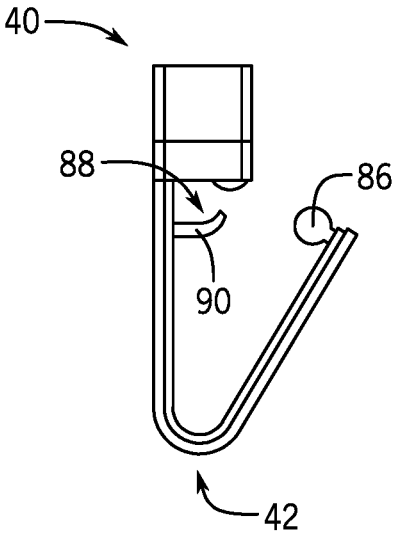
FIG. 5C is a side view of the lanyard clip of FIG. 5A.
Figure 5D:
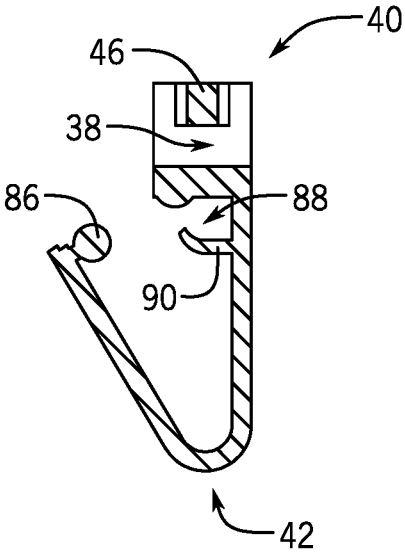
FIG. 5D is a side cross-sectional view of the badge clip of FIG. 5A.

As shown in FIGS. 5C-5D, the lanyard clip 40 includes a cylindrical protrusion 86 affixed on an interior edge at the end of the lanyard clip 40. The lanyard clip 40 also includes a lanyard clip slot 88 that is substantially parallel relative to the cylindrical protrusion 86, and that includes a hooked edge 90 that curves away from the lanyard clip retaining portion 42. The lanyard clip slot 88 is configured to receive the cylindrical protrusion 86, where the hooked edge 90 retains the cylindrical protrusion 86, thus locking the lanyard clip 40. In some embodiments where the identification card is received by the lanyard clip retaining portion 42 of the lanyard clip 40, the lanyard clip 40 is locked and the identification card is prevented from sliding out of the lanyard clip 40. In some embodiments, such as in other configurations, the lanyard beam 74 of the housing 12 is received by the lanyard clip retaining portion 42 of the lanyard clip 40. Thus, locking of the lanyard clip 40 prevents the housing 12 from sliding out of the lanyard clip 40.

Generally, the lanyard clip 40 can be made of various materials that allow for the above-discussed functionality. For example, the lanyard clip 40 can be made of plastic (for example, polyoxymethylene, and so forth). In some embodiments the lanyard clip 40 has specified dimensions. For example, the lanyard clip width 43 can be ⅜", ⅝", ¾", 1", and so forth. In some embodiments, the dimensions for the lanyard clip 40 also identically correspond to the badge clip 32. In some embodiments, the badge clip width 37 can be ⅜", ⅝", ¾", 1", and so forth.

As illustrated and similarly as discussed with regard to the badge clip 32, the lanyard clip 40 is structured as a "snap-clip," where the cylindrical protrusion 86 is forced into the lanyard clip slot 88, and the hooked edge 90 imposes a retracting force onto the cylindrical protrusion 86, thereby securing the cylindrical protrusion 86 into the lanyard clip slot 88. However, other clips known in the art (for example, a spring clip, a derlin clip, a push clip, a bulldog swivel clip, a clip connector, a lever clip, a mobile connector, an alligator clip, and so forth) can be substituted for the illustrated embodiment of the lanyard clip 40, in order to secure the identification card or the housing 12 to the other clip, and to secure the lanyard to the other clip.

Referring now to FIGS. 1A-5D collectively, the function and usage of the badge reel device 10 can be more easily understood. The badge reel device 10 can uniquely be worn by the user in at least two specific configurations.

In a first wearing configuration, the user wears the badge reel device 10 via a lanyard. The lanyard is secured to the lanyard clip 40, via the lanyard slot 38. The lanyard clip 40 is then secured to the housing 12, via the receiving of the lanyard beam 74 by the lanyard clip retaining portion 42.

The badge retaining portion 36 receives an identification card and the badge clip 32 is closed and secured. The lanyard is placed around a user's neck or shoulders, where the housing 12 is suspended from and supported by the lanyard.

As detailed above, and although desirable in some scenarios, previous lanyard configurations that only include the identification card supported by the lanyard, have limitations. For example, when a user desires entry into a secured location of a building, the identification card must be brought into close proximity to the card reader, which is typically mounted on a wall adjacent to a door handle. Thus, a user has to either remove the lanyard or bend their back in an awkward manner, in order to correspondingly place the identification card in close proximity to the reader. Either of these scenarios can be inconvenient to a user. Upon removal of the lanyard (and identification card), the user risks misplacing the lanyard, and thus introduces the possibility that the user exits the entryway leaving the lanyard in the secured location. This ultimately locks the user out of the secured location, and requires the user to seek additional help in order to retrieve their lanyard (and identification card). Similarly, the user may rather choose to bend their back, which can be uncomfortable to the user.

The inconveniences discussed above, are avoided by using the first configuration of the badge reel device 10. The user does not have to remove the lanyard (and identification card) to bring the identification card in close proximity to the card reader. Rather, the user simply has to pull the identification card in tension, thereby rotating and unravelling the spool 28 to increase the length of the portion of retractable cord 16 that is exteriorly positioned with respect to the housing 12. Once the user extends the identification card in close proximity to the reader, the user can correspondingly release the identification card. Upon releasing, due to the rotational biasing of the spool 28, the spool 28 rotates in an opposite direction to rewind the retractable cord 16 around the spool 28. Similarly, due to the rotational biasing of the spool 28, the retractable cord 16 will rewind until the badge clip 32 is received into the recess 19 of the housing 12. In some embodiments, biasing of the spool 28 provides a retractable force to urge the badge clip 32 into the recess 19 of the housing 12 without the need of previously pulling the identification card in tension, in order to generate a rotational bias on the spool 28.

In a second wearing configuration, any lanyard clip may be removed (or not added in the first instance) and the attachment clip 22 on the back of the housing 12 is used to engage a user's clothing (for example, a belt, a waistband, and so forth), thus securing the housing 12 relative to the user. In this configuration, the badge clip 32 can still support the card relative to the housing 12 and permit the card or badge to be temporarily extended away from the body of the wearer. Specifically the user may increase the length of the retractable cord 16 that is exterior to the housing 12, in order to move the card in close proximity to a card reader which may prevent the user from needing to thrust a hip toward a reader. Thus, the difference between the first and second configurations is the securement structure (that is, lanyard versus attachment clip) while both still offer the retractable badge or card mechanism.

This system offers still further advantageous to other previous lanyard and badge reel systems. A common occurrence with previous lanyard and badge reel systems is the tendency for the identification card to rotate relative to the lanyard or the badge reel. This rotation can be undesirable, as it fails to display the identification card properly at all times. Components that form the badge reel device 10 address these undesirable characteristics by at least temporarily locking the rotation of some components relative to the others, sometimes in collective "stacked" locked rotation across the items. Specifically, the engagement of the badge clip 32 with the recess 19 in the housing prevents rotation of the identification card in the retracted position. For example, when the badge clip 32 engages and secures an identification card and when the badge clip 32 is received in the recess 19, the recess 19 prevents rotation of the badge clip 32, thus preventing rotation of the identification card secured by the badge clip 32. As another example of reduced rotation of the identification card, when the badge clip 32 engages the identification card, a badge clip width 37 of the badge clip 32 engages the identification card, thus preventing rotation of the identification card relative to the badge clip 32, as the badge clip 32 forces the identification card and the badge clip 32 to rotate together. As a further example of reduced rotation of the identification card, when the lanyard clip width 43 of the lanyard clip 40 engages the identification card, the lanyard clip 40 is closed and secured, thus forcing the identification card to rotate with the lanyard clip 40.

As noted above, it should be appreciated that various other modifications and variations to the preferred embodiments can be made within the spirit and scope of the invention. Therefore, the invention should not be limited to the described embodiments. To ascertain the full scope of the invention, the following claims should be referenced.

What is claimed is:

1. A badge reel device for attachment to a user via either a lanyard or an attachment clip, the badge reel device comprising:

a housing including a front cover and a rear cover connected together and having a clamshell configuration in which the front cover and the rear cover are securedly engaged with one another and further having sidewalls having an exterior surface and an interior surface in which the interior surface defines an internal volume of the housing and in which the housing further includes an aperture for a cord extending through the sidewalls;

a retractable cord partially disposed within the internal volume of the housing and extending through the aperture of the housing for attachment to a badge at a badge-attachment end of the retractable cord;

an attachment clip on the housing, the attachment clip configured for attachment to the user to wear the badge reel device in a first wearing mode via the attachment clip; and a lanyard attachment structure on the housing including a lanyard beam integral with one of the front cover and the rear cover of the housing, the lanyard beam being substantially parallel to a portion of the exterior surface of the housing, the lanyard attachment structure configured for attachment to a lanyard for the user to wear the badge reel device in a second wearing mode via the lanyard.

2. The badge reel device of claim 1, wherein an exterior portion of the front cover has a label, and wherein the label is advertisement, a logo, or a brand name.

3. The badge reel device of claim 1, wherein the lanyard attachment structure forms a loop.

4. The badge reel device of claim 1, wherein the badge-attachment end of the retractable cord includes a badge clip.

5. The badge reel device of claim 4, wherein the badge clip includes a badge clip aperture for receiving an end of the retractable cord thereby securing the badge clip to the end of the retractable cord.

6. The badge reel device of claim 5, wherein the housing further comprises a recess configured to receive the badge clip when the retractable cord is in a retracted state.

7. The badge reel device of claim 6, wherein the receiving of the badge clip into the recess of the housing prevents rotation of the badge clip, thereby also preventing rotation of the badge clip relative to the housing.

8. The badge reel device of claim 7, wherein the badge clip receives the badge.

9. The badge reel device of claim 8, wherein the badge clip is dimensioned such that when the badge clip receives the badge, rotation between the badge and the badge clip is prevented.

10. The badge reel device of claim 4, wherein the badge clip includes a hooked edge defining a slot and a cylindrical protrusion, and wherein, when the cylindrical protrusion is received within the slot, the badge clip locks.

11. The badge reel device of claim 1, wherein the lanyard attachment structure includes a lanyard clip received on the lanyard beam.

12. The badge reel device of claim 11, wherein the lanyard clip includes a lanyard slot configured to receive the lanyard.

13. The badge reel device of claim 11, wherein the lanyard clip includes:

a lanyard bar defining a lanyard slot;

a hooked edge;

a cylindrical protrusion; and a retaining portion, and wherein the lanyard is coupled to the lanyard bar, and wherein, when the lanyard beam is received by the retaining portion of the lanyard clip, the cylindrical protrusion is received by the hooked edge to couple the lanyard clip to the housing.

14. The badge reel device of claim 1, further comprising:

a spool disposed within the internal volume of the housing and biased in a first direction in which at least a portion of the retractable cord partially disposed within the internal volume is wrapped around the spool;

wherein tension on the portion of the retractable cord extending through the aperture of the housing rotates the spool in a second direction thereby unraveling a greater length of the retractable cord; and wherein releasing the tension on the portion of the retractable cord extending through the aperture of the housing rotates the spool back in the first direction thereby retracting the greater length of the retractable cord onto the spool.

15. The badge reel device of claim 1, wherein the attachment clip is configured to slidably engage a portion of clothing.

16. The badge reel device of claim 15, wherein the portion of clothing is a belt, a belt loop, or a waist region of a pair of pants.

17. The badge reel device of claim 1, wherein the interior surface of the housing includes a protrusion received by the attachment clip to secure the attachment clip to the housing.

18. The badge reel device of claim 1, wherein the housing includes a recess, the recess being rectangular, and wherein with the badge secured to the badge clip and the badge clip received in the recess, rotation of the badge relative to the housing is prevented.

* * * * *